US009650591B2

(12) United States Patent
Ferrieux et al.

(10) Patent No.: US 9,650,591 B2
(45) **Date of Patent: *May 16, 2017**

(54) AUTOMATIC DISHWASHING DETERGENT

(71) Applicants: Rohm and Haas Company, Philadelphia, PA (US); Union Carbide Chemicals & Plastics Technology LLC, Midland, MI (US)

(72) Inventors: Severine Ferrieux, Grasse (FR); Scott Backer, Philadelphia, PA (US); Paul Mercando, Pennsburg, PA (US); Eric P. Wasserman, Hopewell, NJ (US)

(73) Assignees: Rohm and Haas Company; Union Carbide Chemicals & Plastics Technology LLC

( * ) Notice: Subject to any disclaimer, the term of this patent is extended or adjusted under 35 U.S.C. 154(b) by 0 days.

This patent is subject to a terminal disclaimer.

(21) Appl. No.: 14/910,052

(22) PCT Filed: Sep. 3, 2014

(86) PCT No.: PCT/US2014/053856

§ 371 (c)(1),
(2) Date: Feb. 4, 2016

(87) PCT Pub. No.: WO2015/034895

PCT Pub. Date: Mar. 12, 2015

(65) Prior Publication Data

US 2016/0201012 A1 Jul. 14, 2016

(30) Foreign Application Priority Data

Sep. 5, 2013 (EP) ..... 13290210

(51) Int. Cl.

| | |
|---|---|
| ***C11D 1/00*** | (2006.01) |
| ***C11D 3/04*** | (2006.01) |
| ***C11D 3/37*** | (2006.01) |
| ***C11D 3/00*** | (2006.01) |

(52) U.S. Cl.
CPC ..... *C11D 3/0036* (2013.01); *C11D 3/3769* (2013.01)

(58) Field of Classification Search
CPC .... C11D 1/00; C11D 3/04; C11D 3/37; C11D 3/3746; C11D 3/3769
See application file for complete search history.

(56) References Cited

U.S. PATENT DOCUMENTS

| | | | | |
|---|---|---|---|---|
| 4,906,383 | A | 3/1990 | Chen et al. | |
| 4,913,880 | A | 4/1990 | Chen et al. | |
| 2008/0262192 | A1* | 10/2008 | Yoneda | C02F 1/56 528/332 |
| 2011/0183880 | A1 | 7/2011 | Yoneda et al. | |

FOREIGN PATENT DOCUMENTS

| | | |
|---|---|---|
| WO | 2006064940 | 6/2006 |
| WO | 2007073801 | 7/2007 |
| WO | 2007089001 | 8/2007 |

OTHER PUBLICATIONS

Third party observations submitted in the corresponding PCT application.

* cited by examiner

*Primary Examiner* — Brian P Mruk
(74) *Attorney, Agent, or Firm* — Marcella M. Bodner; Thomas S. Deibert

(57) ABSTRACT

Described are automatic dishwashing detergents, comprising a builder, a surfactant, and a polymer comprising units derived from at least one carboxylic acid monomer or its salt, at least one allyl glycidyl ether (AGE) and iminodiacetic acid (IDA), said polymer having Formula I: (Formula I) wherein m; n; R, $R^1$, $R^2$, and X are as defined herein. In some embodiments, an AGE and iminodiacetic acid (IDA) are first reacted to produce an ethylenically unsaturated aminocarboxylic acid monomer, which is then polymerized with at least one carboxylic acid monomer to produce the polymer having Formula I. Alternatively, an AGE is polymerized with at least one carboxylic acid monomer to produce a polymer, which is then reacted to graft IDA thereon to form the polymer having Formula I.

Formula I

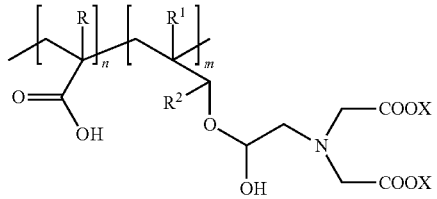

5 Claims, No Drawings

AUTOMATIC DISHWASHING DETERGENT

CROSS REFERENCE TO RELATED APPLICATIONS

This application is a 35 USC §371 national phase filing of PCT/US2014/053856 filed Sep. 3, 2014, which claims benefit of priority from European Patent Application Number 13290210.7, filed Sep. 5, 2013, which application is incorporated by reference herein in its entirety.

FIELD

The present invention relates to automatic dishwashing detergent containing acrylic polymers having chelating moieties. In particular, the polymers comprise polymerized units derived from (meth)acrylic acid, iminodiacetic acid and allyl glycidyl ether.

BACKGROUND

Historically, phosphates have been used as builders for detergents, including automatic dishwashing (ADW) detergents, due to their excellent chelating agent performance. However, due to aquatic plant stimulation effects, most jurisdictions have limited or banned the use of phosphates in detergents. In the absence of chelating phosphates, there has been an important need for development of new and effective chelating agents, dispersants, and/or builders for ADW detergents having little or no phosphate in them. Polyacrylate dispersants are known to inhibit crystal growth and assist with particle dispersion. Amino carboxylates stoichiometrically bind metal ions, thereby enhancing scale inhibition, and are being explored as another class of chelants that may replace phosphates in detergents and other aqueous systems.

(Meth)acrylic acid based polymers have been found to provide good anti-redeposition characteristics in laundry detergents, as described in International Patent Application Publication No. WO 2007/089001. The polymers described in WO 2007/089001 were derived from (meth)acrylic acid monomers, (meth)acrylate monomers, and one or more other monomers such as those having amino, hydroxyl or sulfonic functional groups. These polymers had weight average molecular weight ($MW_w$) from 2,000 to 100,000, most preferably from 4,000 to 60,000 and, according to WO 2007/089001, a $MW_w$. "less than 2,000 reduces dispersibility for soil and could reduce also prevention capability of soil redeposition," which clearly advises against use of such polymer having $MW_w$ less than about 2,000.

United States Patent Application Publication No. US 2008/0262192 disclosed water soluble polymers derived from amino group-containing allyl monomers and useful as cleaners, water-treatment agents and fiber treatment agents. These polymers are characterized as having a molecular weight distribution of 12 or less, and $MW_w$ from 1,000 to 100,000, most preferably from 5,000 to 20,000.

A family of patents which includes U.S. Pat. Nos. 4,906,383 and 4,913,880 described polymers useful for water treatment and derived from α-, β-ethylenically unsaturated monomers, which contain carboxylic acid or carboxylic amide functionalities, and amine-containing allyl ether monomers. These patents taught that the amine-containing allyl ether monomers were derived from the ring opening reaction of a (meth)allylic glycidyl ether, preferably allyl glycidyl ether (AGE), with ammonia, primary, secondary or tertiary amines, for example carboxylate-containing amines such as iminodiacetic acid (IDA). It was contemplated that these polymers, comprising both amine and carboxylic functionalities, would be useful in a broad range of water treatment applications including scale inhibition in water systems such as cooling, boiler, gas scrubbing, and pulp and paper manufacturing systems, as well as corrosion inhibitors and chelating activity for various metal ions in solution. It was further stated that such polymers may be used to prevent precipitation of various calcium-based fouling solids, as well as various metal oxide and metal hydroxide deposits, in water systems.

Moreover, polyacrylate polymers which contain sulfonic acid monomers, such as 2-acrylamido-2-methylpropane sulfonic acid (AMPS), are known to provide good inhibition against silica-based scale formation. Polymers commercially available under the tradename ACUSOL 588 from Dow Chemical Company contain acrylic acid and AMPS monomers and have been marketed for use in ADW detergents to control silica- and phosphorus-based scales. With the advent of phosphorus-free ADW detergents, ACUSOL 588 and similar dispersants remain effective at controlling silica-based scale.

Chelants may be added to phosphorus-free ADW detergents to aid scale inhibition. For example, methylglycine diacetic acid (MGDA) is commonly used in ADW detergents in place of phosphorus to bind calcium and magnesium ions and thereby inhibit formation of carbonate-based scales. However, MGDA is known to cause equipment corrosion in high amounts and lead to formation of nitriloacetic acid (NTA), a known carcinogen. Thus, if other chelants can be identified as effective for inhibiting scale formation in phosphate-free ADW detergents, all or a portion of the MGDA could be replaced by such other chelants without reduction of detergent effectiveness.

Notwithstanding the foregoing developments, there remains a need for anti-scaling agents for ADW detergents to replace the now-disfavored phosphates that previously inhibited scale build-up.

SUMMARY OF THE INVENTION

The present invention provides an automatic dishwashing detergent, comprising: (A) a builder; (B) a surfactant; and (C) a polymer comprising polymerized units derived from at least one carboxylic acid monomer or its salt, at least one allyl glycidyl ether (AGE) and iminodiacetic acid (IDA). The polymer has the following Formula I:

Formula I

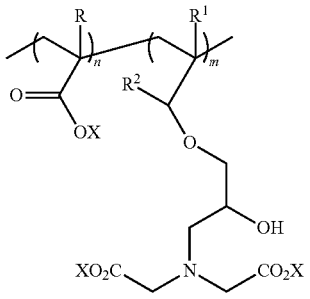

wherein m is an integer from 1 to 6; n is an integer from 1 to 20; each of R and $R^1$ is, independently, H or $CH_3$; $R^2$ is $H_2$ or =O; and each X is, independently, H, $K^+$, $Na^+$, or ammonium ($NH_4^+$).

In some embodiment, the polymer having Formula I comprises polymerized units derived from at least one carboxylic acid monomer and at least one ethylenically unsaturated aminocarboxylate monomer, wherein the ethylenically unsaturated aminocarboxylate monomer is the reaction product of an AGE and IDA.

In some embodiments, the polymer having Formula I is the reaction product of IDA and a polymer comprising polymerized units derived from at least one carboxylic acid monomer and an AGE.

In some embodiments, the carboxylic acid monomer or its ester is selected from: acrylic acid, methacrylic acid, their salts, and mixtures thereof.

DETAILED DESCRIPTION

All percentages stated herein are weight percentages (wt %), unless otherwise indicated.

Temperatures are in degrees Celsius (° C.), and ambient temperature means between 20° C. and 25° C., unless specified otherwise.

Weight percentages of monomers in a polymer are based on the total weight of monomers present in the polymerization mixture from which the polymer is produced.

Weight average molecular weights, $MW_w$, are measured by gel permeation chromatography (GPC) using polyacrylic acid standards, as is known in the art.

The term "polymerized units derived from" as used herein refers to polymer molecules that are synthesized according to polymerization techniques wherein a product polymer contains "polymerized units derived from" the constituent monomers which are the starting materials for the polymerization reactions.

"Polymer" means a polymeric compound or "resin" prepared by polymerizing monomers, whether of the same or different types. The generic term "polymer," as used herein, includes the terms "homopolymer" and "copolymer". For example, homopolymers are polymeric compounds are understood to have been prepared from a single type of monomer. Copolymers, as this term is used herein, means polymeric compounds prepared from at least two different types of monomers. For example, an acrylic acid polymer comprising polymerized units derived only from acrylic acid monomer is a homopolymer, while a polymer comprising polymerized units derived from acrylic acid, methacrylic acid, and butyl acrylate is a copolymer.

Hereinbelow, where "ethylenically unsaturated" is used to describe a molecule or moiety, it means that that molecule or moiety has one or more carbon-carbon double bonds, which renders it polymerizable. The term "ethylenically unsaturated" includes monoethylenically unsaturated (having one carbon-carbon double bond) and multi-ethylenically unsaturated (having two or more carbon-carbon double bonds).

As used herein, "carboxylic acid monomers or their esters" include, for example, acrylic acid, methacrylic acid, their salts, their esters, and mixtures thereof.

As used herein "(meth)acrylic acid" means acrylic acid, methacrylic acid, or mixtures thereof.

As used herein, "(meth)acrylate" means esters of acrylic acid, esters of methacrylic acid, or mixtures thereof.

The present invention provides dishwashing detergents comprising:

(A) a builder;

(B) a surfactant; and (C) a polymer comprising polymerized units derived from at least one carboxylic acid monomer or its salt, at least one allyl glycidyl ether (AGE) and iminodiacetic acid (IDA), said polymer having Formula I:

Formula I

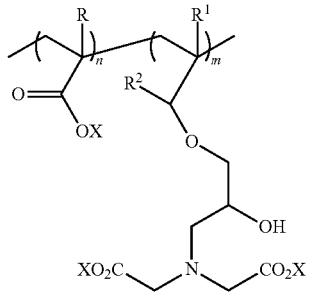

wherein m is an integer from 1 to 6; n is an integer from 1 to 20; each of R and $R^1$ is, independently, H or $CH_3$; $R^2$ is $H_2$ or =O; and each X is, independently, H, $K^+$, $Na^+$, or ammonium ($NH_4^+$).

Suitable carboxylic acid monomers or their esters are selected from acrylic acid, methacrylic acid, their salts, and mixtures thereof. The polymer may, for example, comprise 20-99 wt % of carboxylic acid monomers or their esters, based on the total weight of the polymer. In some embodiments, the polymer comprises at least 5 wt %, for example, at least 10 wt %, or at least 20 wt %, or even at least 25 wt %, of polymerized units derived from at least one carboxylic acid monomer or its salt. In some embodiments, the polymer comprises up to 95 wt %, or up to 90 wt %, or up to 80 wt %, or even up to 75 wt %.

Suitable ethylenically unsaturated aminocarboxylate monomers are derived from the reaction of an allyl glycidyl ether (AGE) and iminodiacetic acid (IDA), said aminocarboxylate monomer having Formula II:

Formula II

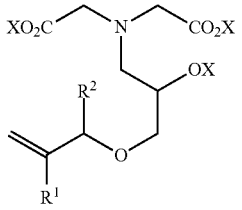

wherein $R^1$ is H or $CH_3$; $R^2$ is $H_2$ or =O; and each X is, independently, H, $K^+$, $Na^+$, or ammonium ($NH_4^+$).

In some embodiments, the builder is at least one of sodium citrate, citric acid, or sodium carbonate.

In some embodiments, the surfactant is at least one nonionic surfactant that is typically used in automatic dishwashing detergents, for example, low foam surfactants (ethylene oxide/propylene oxide/ethylene oxide triblock polymers, alkyl-ethylene oxide/propylene oxide/butyl oxide polymers). Such surfactants are well known, and selection thereof is understood, by persons of ordinary skill in the relevant art. Some suitable commercially available surfactants are listed in the following table.

| Name | Summary Composition |
|---|---|
| DOWFAX 20B102 | linear alcohol EO BO |
| TRITON DF-16 | linear alcohol EO PO |
| TERGITOL L-61E | EO/PO copolymer |
| ECOSURF LF-20 | secondary alcohol EO BO |

(Abbreviations above as follows: EO = ethylene oxide, BO = butylene oxide, PO = propylene oxide)
DOWFAX, TRITON, TERGITOL and ECOSURF are trademarks of Dow Chemical Company of Midland, Michigan, USA.

Without being bound by theory, the polymer of Formula I, in accordance of the present invention, appears to have excellent chelating ability. In one embodiment, the monomer of Formula II accounts for 1-50 wt % of the polymer, preferably 5 to 15 wt % of said polymer.

In some embodiments, m of Formula I may be an integer from 1 to 4, or from 1 to 3, or even from 1 to 2. In some embodiments, m of Formula I is 1.

In some embodiments, n of Formula I may be an integer from 1 to 16, or from 4 to 16, or from 5 to 16, or even from 5 to 12. In some embodiments, n of Formula 1 is 1.

In some embodiments, in Formula I, $R^1$ is H, and $R^2$ is $H_2$. This is can be achieved, for example, by synthesizing the aminocarboxylate monomer by reacting an allyl glycidyl ether monomer (AGE) with IDA, or obtaining an aminocarboxylate monomer which was synthesized from such reactants.

In some embodiments, in Formula I, $R^1$ is $CH_3$, and $R^2$ is =O. This is can be achieved, for example, by synthesizing the aminocarboxylate monomer by reacting glycidyl methacrylate monomer (GMA) with IDA, or obtaining an aminocarboxylate monomer which was synthesized from such reactants.

In some embodiments, the polymer may further comprise an ethylenically unsaturated monomer selected from esters of (meth)acrylic acids and $C_1$-$C_{12}$ aliphatic alcohols. In one embodiment, this monomer is present in 1-30 wt % of the polymer.

In some embodiments, the polymer further comprises an ethylenically unsaturated monomer selected from amides of (meth)acrylic acids, including those with $C_1$-$C_6$ aliphatic alkyls. In one embodiment, this monomer is present in 1-30 wt % of the polymer.

In one embodiment, the polymer further comprises an additional monomer component comprising one or more ethylenically unsaturated monomers selected from the group consisting of esters of carboxylic acids, carboxylic acid anhydrides, imides, amides, styrenes, sulfonic acids, and combinations thereof. Such additional monomer is typically 1-30 wt % of the polymer.

For example, carboxylic acid monomers suitable for use as the additional monomer component include acrylic acid, methacrylic acid, and salts and mixtures thereof. Sulfonic acid monomers include, for example, 2-acrylamido-2-methylpropane sulfonic acid (AMPS), 2-(meth)acrylamido-2-methylpropane sulfonic acid, 4-styrenesulfonic acid, vinylsulfonic acid, 2-sulfoethyl(meth)acrylic acid, 2-sulfopropyl (meth)acrylic acid, 3-sulfopropyl(meth)acrylic acid, and 4-sulfobutyl(meth)acrylic acid, and salts thereof.

Further examples of ethylenically unsaturated monomers suitable for use as the additional monomer component of the polymer include, without limitation, itaconic acid, maleic acid, maleic anhydride, crotonic acid, vinyl acetic acid, acryloxypropionic acid, methyl acrylate, ethyl acrylate, butyl acrylate, methyl methacrylate, ethyl methacrylate, butyl methacrylate and isobutyl methacrylate; hydroxyalkyl esters of acrylic or methacrylic acids such as hydroxyethyl acrylate, hydroxypropyl acrylate, hydroxyethyl methacrylate, and hydroxypropyl methacrylate; acrylamide, methacrylamide, N-tertiary butyl acrylamide, N-methyl acrylamide, N,N-dimethyl acrylamide; acrylonitrile, methacrylonitrile, allyl alcohol, allyl sulfonic acid, allyl phosphonic acid, vinylphosphonic acid, dimethylaminoethyl acrylate, dimethylaminoethyl methacrylate, phosphoethyl methacrylate, phosphonoethyl methacrylate (PEM), and sulfonoethyl methacrylate (SEM), N-vinyl pyrollidone, N-vinylformamide, N-vinylimidazole, ethylene glycol diacrylate, trimethylolpropane triacrylate, diallyl phthalate, vinyl acetate, styrene, divinyl benzene, allyl acrylate, 2-acrylamido-2-methyl propane sulfonic acid (AMPS) and its salts or combinations thereof.

In addition to the above-described polymer, builder and surfactant, the automatic dishwashing detergent of the present invention may further comprise at least one bleaching agent, aminocarboxylate, or enzyme. A preferred bleaching agent is sodium percarbonate. Exemplary aminocarboxylates include methylglycine diacetic acid (MGDA), glutamic acid diacetic acid (GLDA), and their sodium salts, and 2-hydroxyethyliminodiacetic acid disodium salt (HEIDA). The enzyme may, for example, be at least one of lipases, proteases, or amylases.

In some embodiments, the detergent further comprises a phosphonate, preferably hydroxyethyldiphosphonic acid (HEDP).

In some embodiments, the detergent is a phosphate-free detergent.

In some embodiments, the detergent further comprises fragrances; solvents ((i.e. polyglycols, alcohols, diols, triols, glycol ethers, water); coupling agents (sodium xylenesulfonate (SXS), sodium cumene sulfonate (SCS)); filler/adjuvants (sodium sulfate, sodium chloride); binders (polyethylene glycol (PEG)); disintegrants (superabsorbent polymer, cellulosic); or corrosion inhibitors (silicates).

In some embodiments, the polymer of Formula I may be prepared by first reacting iminodiacetic acid (IDA), or its salt, with allyl glycidyl ether (AGE) or glycidyl (meth) acrylate (GA or GMA) to form ethylenically unsaturated aminocarboxylic monomers, including IDA-AGE, IDA-GA, and IDA-GMA. In practice, a mixture of isomers is produced. If desired, further reaction with additional quantities of chloroacetic acid can increase yields in situations that would be recognized by those skilled in the art.

Ethylenically unsaturated aminocarboxylic monomers, whether synthesized as above or obtained in already-synthesized form, are then polymerized with the carboxylic acid or its salt to produce the polymer of Formula I In some embodiments, the polymer of Formula I may be prepared by first polymerizing an allyl glycidyl ether with a carboxylic acid selected from acrylic acid, methacrylic acid, their salts, and combinations thereof to provide a polymer backbone. Next, iminodiacetic acid (IDA) is grafted onto the polymer backbone to produce the polymer of Formula I.

The method of polymerization is not particularly limited and may be any method known, now or in the future, to persons of ordinary skill including, but not limited to, emulsion, solution, addition and free-radical polymerization techniques.

When initiator is used, it may be added in any fashion, at any time during the process. Production of the polymer may also involve the use of a chain transfer agent.

In use, the polymer can be used in compositions for automatic dishwash, or industrial ware wash, machines. In practice, such compositions can be formulated in any conventional form, such as tablets, powders, monodose units, multi-component monodose units, sachets, pastes, liquids, or gels. With selection of an appropriate product form and addition time, the polymer composition may be present in the prewash, main wash, penultimate rinse, final rinse, or any combination of these cycles. The polymer is contemplated to be present in such compositions from 0.5 wt % to 40 wt %, preferably from 3 wt % to 30 wt %, more preferably 5 wt % to 20 wt %.

EXAMPLES

Example 1—Synthesis and Base Formulas

Synthesis of IDA-AGE Monomer—"ACM1"
(Ethylenically Unsaturated Aminocarboxylate Monomer)

To a 1 L round bottom flask equipped with a magnetic stirbar and an addition funnel, 211.7 g of iminodiacetic acid (IDA) solution (20.0) % active was charged. The solution was placed in a water bath, and set to stir at a minimum of 300 rpm, and heated to 35° C. During this time, 27.3 grams of allyl glycidyl ether (AGE) was charged to an addition funnel. The AGE was added drop wise to the stirring reaction mass over 20-30 minutes. When complete, the mixture was allowed to stir at 35° C. until the reaction mass transitioned from two phases to a single phase, requiring a hold time of 30-60 minutes. This was determined by visual observation, in which prior to completion, the reaction mass was hazy, and would separate into two distinct phases upon termination of stirring. Upon completion, the reaction mass was observed to be a transparent yellow solution, which was stable upon termination of stirring. At this stage the product is a yellow solution of pH 12 and active level of 29.84 wt % IDA-AGE. This solution is stable to storage under ambient conditions and can be used as such.

Polymer I
Synthesis of Poly-(AA/IDA-AGE)

To a three liter round bottom flask, equipped with a mechanical stirrer, heating mantle, thermocouple, condenser and inlets for the addition of monomer, initiator and chain transfer agent (CTA) was charged 113.1 grams of 29.84% IDA-AGE and 15 grams of deionized water. The mixture was set to stir and heated to 78° C. (+/−2° C.). In the meantime, a monomer solution of 191.25 grams of glacial acrylic acid and was added to a graduated cylinder for addition to the flask. An initiator solution of 6.0 grams of sodium persulfate was dissolved in 50 grams of deionized water and added to a syringe for addition to the kettle. A chain transfer agent (CTA) solution of 51.75 grams of sodium metabisulfite dissolved in 150 grams of deionized water was added to a syringe for addition to the kettle.

Once the kettle contents reached reaction temperature of 78° C., the monomer, initiator and CTA solutions were begun. The monomer feed was added over 90 minutes, CTA cofeed added over 80 minutes and initiator cofeed added over 95 minutes at 78° C.

At the completion of the feeds, 15 grams of deionized water was added to the monomer feed vessel, as rinse. The reaction was held for 15 minutes at 78° C. In the meantime, two chaser solutions of 0.87 grams of sodium persulfate and 25 grams of deionized water was mixed and set aside.

At the completion of the hold, the above solutions were added linearly over 10 minutes and held for 20 minutes at 78° C. The chaser solution preparations were repeated and added to the kettle over 10 minutes, followed by a 20 minute hold.

At the completion of the final hold, cooling was begun with the addition of 30 grams of deionized water. At 50° C. or below a solution of 192.8 grams of 50% sodium hydroxide was added to an addition funnel and slowly added to the kettle, controlling the exotherm to keep the temperature below 65° C. Finally, 7.5 grams of a scavenger solution of 35% hydrogen peroxide was added to the kettle.

The reaction product was then cooled and packaged.

The final Polymer I had a solids content of 40.17% (as measured in a forced draft oven at 150° C. for 60 minutes). The pH of the solution was 7.19 and final molecular weight as measured by Gel Permeation Chromatography was 7,249 Daltons.

Polymer II
Synthesis of Poly-(AA/AMPS/IDA-AGE)

To a three liter round bottom flask, equipped with a mechanical stirrer, heating mantle, thermocouple, condenser and inlets for the addition of monomer, initiator and chain transfer agent (CTA) was charged 53.69 grams of 37.72% IDA-AGE and 127.5 grams of deionized water. The mixture was set to stir and heated to 78° C. (+/−2° C.). In the meantime, a monomer solution of 148.5 grams of glacial acrylic acid and 112.5 grams of AMPS was added to a graduated cylinder for addition to the flask. An initiator solution of 5.0 grams of sodium persulfate was dissolved in 45 grams of deionized water and added to a syringe for addition to the kettle. A chain transfer agent solution of 31.5 grams of sodium metabisulfite dissolved in 100 grams of deionized water was added to a syringe for addition to the kettle.

Once the kettle contents reached reaction temperature of 78° C., the monomer, initiator and CTA solutions were begun. The monomer feed was added over 90 minutes, CTA cofeed added over 80 minutes and initiator cofeed added over 95 minutes at 78° C.

At the completion of the feeds, 20 grams of deionized water was added to the monomer feed vessel, as rinse. The reaction was held for 15 minutes at 78° C. In the meantime, two chaser solutions of 0.87 grams of sodium persulfate and 16.75 grams of deionized water was mixed and set aside.

At the completion of the hold, the above solutions were added linearly over 10 minutes and held for 20 minutes at 78° C. The chaser solution preparations were repeated and added to the kettle over 10 minutes, followed by a 20 minute hold.

At the completion of the final hold, cooling was begun with the addition of 50 grams of deionized water. At 50° C. or below a solution of 153.4 grams of 50% sodium hydroxide was added to an addition funnel and slowly added to the kettle, controlling the exotherm to keep the temperature below 65° C. Finally, 7.3 grams of a scavenger solution of 35% hydrogen peroxide was added to the kettle.

The reaction product was then cooled and packaged.

The final Polymer II had a solids content of 35.31% (as measured in a forced draft oven at 150° C. for 60 minutes). The pH of the solution was 7.52 and final molecular weight as measured by Gel Permeation Chromatography was 24,580 Daltons.

Polymer III
Synthesis of Poly-(AA/IDA-AGE)

The procedure used to prepare Polymer I above was followed, except that 59.65 grams of 37.72% IDA-AGE and a monomer solution of 202.5 grams of glacial acrylic acid were used.

The final Polymer III had a solids content of 39.42% (as measured in a forced draft oven at 150° C. for 60 minutes).

The pH of the solution was 7.45 and final molecular weight as measured by Gel Permeation Chromatography was 5,663 Daltons.

Polymer IV

Synthesis of Poly-(AA/IDA-AGE)

The procedure used to prepare Polymer I above was followed, except that 89.5 grams of 29.84% IDA-AGE and a monomer solution of 191.25 grams of glacial acrylic acid were used.

The final Polymer IV had a solids content of 39.63% (as measured in a forced draft oven at 150° C. for 60 minutes). The pH of the solution was 7.05 and final molecular weight as measured by Gel Permeation Chromatography was 5,905 Daltons.

Polymer V

Synthesis of Poly-(AA/IDA-AGE)

The procedure used to prepare Polymer I above was followed, except that 119.3 grams of 29.84% IDA-AGE and a monomer solution of 180 grams of glacial acrylic acid were used.

The final Polymer V had a solids content of 38.91% (as measured in a forced draft oven at 150° C. for 60 minutes). The pH of the solution was 7.08 and final molecular weight as measured by Gel Permeation Chromatography was 8,038 Daltons.

Polymer VI

Synthesis of Poly-(AA/IDA-AGE) Phosphino Endgroup

To a three liter round bottom flask, equipped with a mechanical stirrer, heating mantle, thermocouple, condenser and inlets for the addition of monomer, initiator and chain transfer agent was charged 75.4 grams of 29.84% IDA-AGE and 15 grams of deionized water. The mixture was set to stir and heated to 92° C. (+/−2° C.). In the meantime, a monomer solution of 202.5 grams of glacial acrylic acid and was added to a graduated cylinder for addition to the flask. An initiator solution of 5.0 grams of sodium persulfate was dissolved in 45 grams of deionized water and added to a syringe for addition to the kettle. A chain transfer agent solution of 17.94 grams of sodium hypophosphite dissolved in 75 grams of deionized water was added to a syringe for addition to the kettle.

Once the kettle contents reached reaction temperature of 92° C., the monomer, initiator and CTA solutions were begun. The monomer feed was added over 90 minutes, CTA cofeed added over 80 minutes and initiator cofeed added over 95 minutes at 92° C.

At the completion of the feeds, 15 grams of deionized water was added to the monomer feed vessel, as rinse. The reaction was held for 15 minutes at 92° C. In the meantime, two chaser solutions of 0.87 grams of sodium persulfate and 25 grams of deionized water was mixed and set aside.

At the completion of the hold, the above solutions were added linearly over 10 minutes and held for 20 minutes at 92° C. The chaser solution preparations were repeated and added to the kettle over 10 minutes, followed by a 20 minute hold.

At the completion of the final hold, cooling was begun with the addition of 30 grams of deionized water. At 50° C. or below a solution of 208.5 grams of 50% sodium hydroxide was added to an addition funnel and slowly added to the kettle, controlling the exotherm to keep the temperature below 65° C. The reaction product was then cooled and packaged.

The final Polymer VI had a solids content of 36.85% (as measured in a forced draft oven at 150° C. for 60 minutes). The pH of the solution was 7.38 and final molecular weight as measured by Gel Permeation Chromatography was 6,011 Daltons.

TABLE 1

Compositions and Properties of Sample Polymers I-VI

| Sample # | Monomer Composition | CTA* (wt %) | Solids (%) | pH | Viscosity (cps) | $MW_w$ (Daltons) |
|---|---|---|---|---|---|---|
| Polymer I | 85 AA/15 IDA-AGE | 23 SMBS** | 40.17 | 7.2 | 92 | 7,249 |
| Polymer II | 66 AA/25 AMPS/9 IDA-AGE | 6 SMBS | 35.31 | 7.5 | 198 | 24,580 |
| Polymer III | 90 AA/10 IDA-AGE | 18 SMBS | 39.42 | 7.5 | 89 | 5.663 |
| Polymer IV | 85 AA/15 IDA-AGE | 18 SMBS | 39.63 | 7.2 | 107 | 5,905 |
| Polymer V | 80 AA/20 IDA-AGE | 10 SMBS | 38.91 | 7.1 | 99 | 8,038 |
| Polymer VI | 90 AA/10 IDA-AGE | 8 NaHP*** | 36.85 | 7.4 | 86 | 6,011 |

*Chain Transfer Agent levels are in wt % based on total weight of monomers

**SMBS = Sodium metabisulfite

***NaHP = Sodium hypophosphite

Base Formulas A, B and C were prepared and then used to formulate exemplary ADW detergent formulations tested and described in further detail below. The compositions of Base Formulas A, B and C are listed in Table 2.

TABLE 2

Base Formula Compositions

| Ingredients | Formula A (wt %) | Formula B (wt %) | Formula C (wt %) |
|---|---|---|---|
| TRILON ® M MGDA | 25% | 15% | 15% |
| Sodium citrate | 10% | 15% | 15% |
| Sodium carbonate | 20% | 20% | 20% |
| Sodium bicarbonate | | 10% | 10% |
| BRITESIL ® H20 Disilicate | 10% | 10% | |
| Percarbonate | 10% | 15% | 15% |
| TAED | 4% | 4% | 4% |
| Polymer Dispersant | 2.5% | 5% | 5% |
| Surfactant (DOWFAX 20B102) | 2% | 2% | 2% |
| Protease | 2.5% | 2% | 2% |
| Amylase | 1% | 1% | 1% |
| HEDP | 0.5% | 0.5% | 0.5% |
| Sodium sulfate | Up to 100% | Up to 100% | Up to 100% |

Example 2—Performance of Dispersant Polymers in ADW Detergent Formulas

To determine filming and spotting performance of automatic dishwashing detergent containing each of various polymers in accordance with the present invention, a number of ADW formulas were prepared having different dispersant polymers and amounts thereof in Base Formulas A, B and C, and each sample ADW formula was used to wash glasses in automatic dishwashing machines under the following conditions:

Machines: Miele G1222SC Labor

Program: prewash, main wash at 65° C.

Water hardness: 37.5° fH, ratio Ca/Mg 3/1, HCO3 hardness=25° fH

Detergent dosage is 20 grams per wash

The glasses are removed after the third, fifth, tenth, and in some cases fifteenth cycles. Glasses are evaluated in a dark light box by visual observation and rated for filming and spotting.

Filming performance is assessed by trained panelists, and handled with cotton gloves. The evaluation is performed according to ASTM D3556 Standard test method for deposition on glass ware during mechanical dishwashing (Designation D3556-85, re-approved 2009) following the scoring system given below in a light chamber:

1 is best, no spotting, no filming;

2 is random spots and barely perceptible filming;

3 is about a fourth of the surface spotted, slight film;

4 is about half of the surface spotted, moderate film; and 5 is virtually completely covered with spots and heavy film).

Each run is done in presence of 50 grams frozen ballast added during main wash (IKW soil, Industrieverband Körperpflege and Waschmittel e.V., % content: Margarine (10.0); Milk (pasteurized, 3.5% fat) (5.0); Egg yolk (9.4); Benzoic acid (0.1); Potato Starch (0.5); Mustard (2.5); Ketchup (2.5); Water (70.0)).

Performance of Dispersant in Base Formula A

ADW Detergent Formulas A1, A2, A3 and A4 were produced, in each case, by adding to base Formula A 2.5 wt % of the dispersant polymer indicated in Table 3 below. The results of deposition scoring for each of Formulas A1 to A4 is also provided below in Table 3.

TABLE 3

Dispersant Performance in Formula A

| | ADW Formula ID | | | |
|---|---|---|---|---|
| Dispersant | A1 Ac588G* | A2 Polymer III | A3 Polymer IV | A4 Polymer V |
| film cycle 5 | 1.25 | 1.25 | 1.125 | 1.125 |
| film cycle 10 | 1.25 | 1.5 | 1.75 | 1.375 |
| film cycle 15 | 1.25 | 2.875 | 2 | 2 |
| spot cycle 5 | 3.5 | 4 | 3.625 | 3.75 |
| spot cycle 10 | 3.5 | 4.625 | 4.125 | 4.375 |
| spot cycle 15 | 3.5 | 4.125 | 4.625 | 4.625 |

*ACUSOL 588G is an acrylic acid - AMPS copolymer commercially available from DOW Chemical Company of Midland, Michigan, USA Performance of Dispersant in Base Formula B ADW Detergent Formulas B1, B2 and B3 were produced, in each case, by adding to base Formula B 5 wt % of the dispersant polymer indicated in Table 4 below. The results of deposition scoring for each of Formulas B1, B2 and B3 is also provided below in Table 4.

TABLE 4

Dispersant Performance in Formula B

| | ADW Formula ID | | |
|---|---|---|---|
| Dispersant | B1 Ac588G* | B2 Polymer III | B3 Polymer VI |
| film cycle 3 | 1.5 | 1.5 | 1.75 |
| film cycle 5 | 1.5 | 1.5 | 1.25 |
| film cycle 10 | 1.75 | 2.375 | 1.875 |
| spot cycle 3 | 4 | 4 | 3.75 |
| spot cycle 5 | 4.5 | 4 | 4.5 |
| spot cycle 10 | 4.875 | 4.125 | 3.625 |

*ACUSOL 588G is an acrylic acid - AMPS copolymer commercially available from DOW Chemical Company of Midland, Michigan, USA Performance of Dispersant in Base Formula C ADW Detergent Formulas C1, C2 and C3 were produced, in each case, by adding to base Formula C 5 wt % of the dispersant polymer indicated in Table 5 below. The results of deposition scoring for each of Formulas C1, C2 and C3 is also provided below in Table 5.

TABLE 5

Dispersant Performance in Formula C

| | ADW Formula ID | | |
|---|---|---|---|
| Dispersant | C1 Ac588G* | C2 Polymer III | C3 Polymer VI |
| film cycle 3 | 1.25 | 1.5 | 3 |
| film cycle 5 | 1.5 | 1.5 | 2 |
| film cycle 10 | 2.125 | 1.875 | 2.375 |
| spot cycle 3 | 4 | 4 | 2.875 |
| spot cycle 5 | 4.5 | 4.5 | 3.25 |
| spot cycle 10 | 4.625 | 4.25 | 3.625 |

*ACUSOL 588G is an acrylic acid - AMPS copolymer commercially available from DOW Chemical Company of Midland, Michigan, USA

The invention claimed is:

1. An automatic dishwashing detergent, comprising:

(A) a builder;

(B) a surfactant; and (C) a polymer having Formula I:

Formula I

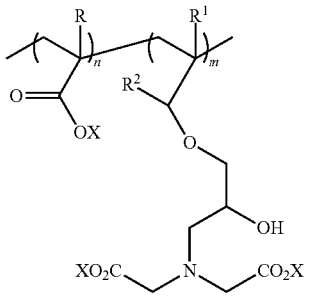

wherein m is an integer from 1 to 6; n is an integer from 1 to 20; R is H or $CH_3$; $R^1$ is $CH_3$; $R^2$ is =O; and each X is, independently, H, $K^+$, $Na^+$, or ammonium ($NH_4^+$); wherein the detergent is phosphate-free.

2. The detergent of claim 1, wherein in Formula I, m is 1 or 2.

3. The detergent of claim 1, wherein in Formula I, n is from 1 to 16.

4. The detergent of claim 1, wherein the polymer further comprises an ethylenically unsaturated monomer selected from esters of (meth)acrylic acids and $C_1$-$C_{12}$ aliphatic alcohols.

5. The detergent of claim 1, wherein the detergent further comprises at least one bleaching agent, aminocarboxylate, or enzyme.

* * * * *